US008528357B2

(12) United States Patent
Kondo et al.

(10) Patent No.: US 8,528,357 B2
(45) Date of Patent: Sep. 10, 2013

(54) ICE-MAKING MACHINE WITH ICE STORAGE BIN

(75) Inventors: Nobuo Kondo, Toyoake (JP); Kiyoshi Yamaoka, Toyoake (JP); Hideyuki Tashiro, Toyoake (JP); Takeshi Ueda, Toyoake (JP); Takashi Hibino, Toyoake (JP); Akira Harata, Toyoake (JP)

(73) Assignee: Hoshizaki Denki Kabushiki Kaisha, Toyoake-Shi, Aichi-Ken (JP)

( * ) Notice: Subject to any disclaimer, the term of this patent is extended or adjusted under 35 U.S.C. 154(b) by 346 days.

(21) Appl. No.: 12/935,745

(22) PCT Filed: Mar. 19, 2009

(86) PCT No.: PCT/JP2009/055441

§ 371 (c)(1),
(2), (4) Date: Sep. 30, 2010

(87) PCT Pub. No.: WO2009/122927

PCT Pub. Date: Oct. 8, 2009

(65) Prior Publication Data

US 2011/0023521 A1 Feb. 3, 2011

(30) Foreign Application Priority Data

Mar. 31, 2008 (JP) ..... 2008-092329

(51) Int. Cl.

| | |
|---|---|
| ***F25D 19/00*** | (2006.01) |
| ***F25D 25/00*** | (2006.01) |
| ***F25D 17/04*** | (2006.01) |
| ***F25D 11/00*** | (2006.01) |
| ***F25C 5/18*** | (2006.01) |

(52) U.S. Cl.

USPC ..... 62/455; 62/377; 62/416; 62/420; 62/424; 62/440; 62/452; 62/454; 62/459; 62/340; 62/344

(58) Field of Classification Search

USPC ..... 62/377, 340, 344, 303, 320, 379, 62/407, 415–416, 420–421, 424–42, 428, 62/440, 448–450, 454–456

See application file for complete search history.

(56) References Cited

U.S. PATENT DOCUMENTS 1,769,119 A * 7/1930 Davenport ..... 62/89
1,887,948 A * 11/1932 Scherer ..... 62/455

(Continued)

FOREIGN PATENT DOCUMENTS

JP 3-129874 12/1991
JP 5-240540 9/1993

(Continued)

OTHER PUBLICATIONS

International Search Report for PCT/JP2009/055441, mailed May 19, 2009.

*Primary Examiner* — Frantz Jules
*Assistant Examiner* — Joseph Trpisovsky
(74) *Attorney, Agent, or Firm* — Nixon & Vanderhye PC

(57) ABSTRACT

An ice-making machine has a box-shaped lower housing with an ice storage bin, a box-shaped upper housing mounted on a rear portion of the lower housing, an ice-making mechanism within the front portion of a machine compartment in the upper housing, and a freezing unit installed behind the ice-making mechanism for supplying refrigerant to the ice-making mechanism. An open-and-close ice-access lid is pivotally mounted between the lower end of the upper housing and the the lower housing. An air intake passage introduces outside cooling air from the front face of the lower housing into the machine compartment along inner surfaces of one side wall and a rear wall of the lower housing. An air discharge passage is provided for passing the air after cooling to flow outward along inner surfaces of the rear wall and the other side wall of the lower housing to an exterior discharge from the front face of the lower housing.

8 Claims, 5 Drawing Sheets

(56) References Cited

U.S. PATENT DOCUMENTS

| | | | | |
|---|---|---|---|---|
| 2,173,150 | A * | 9/1939 | Backstrom | 62/263 |
| 2,549,747 | A * | 4/1951 | Leeson | 62/135 |
| 2,645,100 | A * | 7/1953 | Bascom | 62/263 |
| 3,162,023 | A * | 12/1964 | Smith | 62/455 |
| 4,774,814 | A * | 10/1988 | Yingst et al. | 62/126 |
| 5,193,357 | A * | 3/1993 | Kohl et al. | 62/347 |
| 5,428,973 | A * | 7/1995 | Temmyo et al. | 62/452 |
| 5,752,393 | A * | 5/1998 | Schlosser et al. | 62/303 |
| 6,109,043 | A * | 8/2000 | Lu et al. | 62/73 |
| 6,161,396 | A * | 12/2000 | Allison et al. | 62/347 |
| 6,311,501 | B1 * | 11/2001 | Allison et al. | 62/74 |
| 6,718,793 | B2 * | 4/2004 | Lee | 62/453 |
| 7,216,506 | B2 * | 5/2007 | Shin et al. | 62/508 |
| 7,251,949 | B2 * | 8/2007 | Yamanaka et al. | 62/255 |
| 7,549,300 | B2 * | 6/2009 | Chun et al. | 62/419 |
| 2002/0078705 | A1 * | 6/2002 | Schlosser et al. | 62/352 |
| 2009/0320513 | A1 * | 12/2009 | Yamaoka et al. | 62/340 |

FOREIGN PATENT DOCUMENTS

| | | |
|---|---|---|
| JP | 6-14877 | 2/1994 |
| JP | 7-91811 | 4/1995 |
| JP | 11-148753 | 6/1999 |
| JP | 11-173718 | 7/1999 |
| JP | 2003-161565 | 6/2003 |
| JP | 2003161565 A * | 6/2003 |

* cited by examiner

ICE-MAKING MACHINE WITH ICE STORAGE BIN

This application is the U.S. national phase of International Application No. PCT/JP2009/055441, filed 19 Mar. 2009, which designated the U.S. and claims priority to Japanese Application No. 2008-092329, filed 31 Mar. 2008, the entire contents of each of which are hereby incorporated by reference.

TECHNICAL FIELD

The present invention relates to an ice-making machine equipped with an ice storage bin.

RELATED ART

In patent documents listed below, there has been disclosed an ice-making machine wherein an ice storage bin is provided for storing a large amount of ice cubes supplied from an ice-making mechanism and wherein a freezing unit is installed in a machine compartment formed under the front bottom portion of the storage bin to supply liquid refrigerant into the ice-making mechanism for freezing ice-making water supplied thereto. The ice-making machine is installed in an appropriate place in such a manner that the back portion of the machine is positioned along a side wall of the installation place and that an opening for scooping ice cubes out of the storage bin is formed at the front of the machine housing.

Japanese Patent Laid-open Publication Hei 11(1999)-148753

Japanese Patent Laid-open Publication Hei 11(1999)-173718

In the ice-making machine of the type described above, the cooling air for the freezing unit is introduced from one side of the front of the machine housing and exhausted from the other side of the front of the machine housing after having cooled the freezing unit. Due to such arrangement of the cooling air passage, the space of the machine compartment would be limited if the capacity of the ice storage bin was formed as large as possible. This causes difficulty in installation of the component parts of the freezing unit such as a compressor, a condenser, a cooling fan, etc. and is troublesome in assembly of the freezing unit in the machine compartment and inspection of the freezing unit for maintenance.

In use of the ice-making machine, a user will suffer from unpleasant noises caused by operation of the compressor and cooling fan in the freezing unit installed at the front of the machine housing when approaching to scoop ice cubes out of the storage bin. As the machine compartment for installation of the freezing unit is formed under the front bottom of the ice storage bin, it is difficult to scoop ice cubes out of a deep portion of the storage bin.

BRIEF SUMMARY

To solve such problems, the present exemplary embodiment is directed to provide an ice-making machine which comprises a box-shaped lower housing provided therein with an ice storage bin, a box-shaped upper housing mounted on a rear portion of the lower housing, an ice-making mechanism assembled within the front portion of a machine compartment formed in the upper housing, and a freezing unit installed behind the ice-making mechanism for supplying liquid refrigerant to the ice-making mechanism, wherein an open-and-close lid is mounted on an opening formed between the lower end of the front face of the upper housing and the upper end of the front face of the lower housing, and wherein an air-intake passage is formed to cause outside air introduced from the front face of the lower housing to flow as cooling air into the machine compartment along inner surfaces of one side wall and the rear wall of the lower housing, and an air discharge passage is formed to cause the air after cooling to flow outward along inner surfaces of the rear wall and the other side wall of the lower housing and discharge to the exterior from the front face of the lower housing.

In a practical embodiment of the present invention, the open-and-close lid may be in the form of a lid pivotally mounted at its rear end on the front lower end of the upper housing to be moved up and down for opening and closing the ice storage bin. Alternatively, the open-and-close lid may be in the form of a slide lid mounted at the front lower end of the upper housing for slide movement in a lateral direction to open and close the ice storage bin. In necessity, an air inlet may be formed in a side wall of the lower housing for communication with the air-intake passage. Additionally, an air outlet may be formed in the rear wall of the lower housing for communication with the air discharge passage.

When the cooling fan of the freezing unit is driven in activation of the ice-making machine, the outside air introduced into the air intake passage from the front of the lower housing flows into one side of the machine compartment along an outer surface of the side wall of the ice storage bin for cooling the component parts of the freezing unit. The air after cooling the component parts of the freezing unit is discharged from the other side of the machine compartment into the air discharge passage and flows outward along the other side wall of the ice storage bin. Finally, the air is exhausted to the exterior from the outlet of the air discharge passage located at the front of the lower housing. With such introduction and discharge of the cooling air, the component parts of the freezing unit in the machine compartment are efficiently cooled.

As the air-intake passage and discharge passage are opened at the front of the lower housing, the ice-making machine can be installed closely along a side wall behind thereof or can be installed in a deep space under a service counter. In a condition where the ice-making machine has been installed at a desired place, the freezing unit is located behind the ice-making mechanism and apart from a user approaching the ice storage bin to take out ice cubes. Accordingly, the noises affecting the user are decreased by a noise-block effect of the ice-making mechanism. As the ice-making mechanism and the freezing unit are installed in the machine compartment completely separated from the ice storage bin in the lower housing, the assembly and inspection for maintenance of the component parts can be easily carried out.

It is also advantageous that the ice storage bin can be formed in a desired capacity without any restriction in relation to the arrangement of the ice-making mechanism and the freezing unit. For example, the ice storage bin may be formed at its bottom with a recessed portion in a front-to-rear direction to facilitate takeout of a small amount of ice cubes remaining in the bottom.

DESCRIPTION OF THE PREFERRED EMBODIMENT

Figure 1:
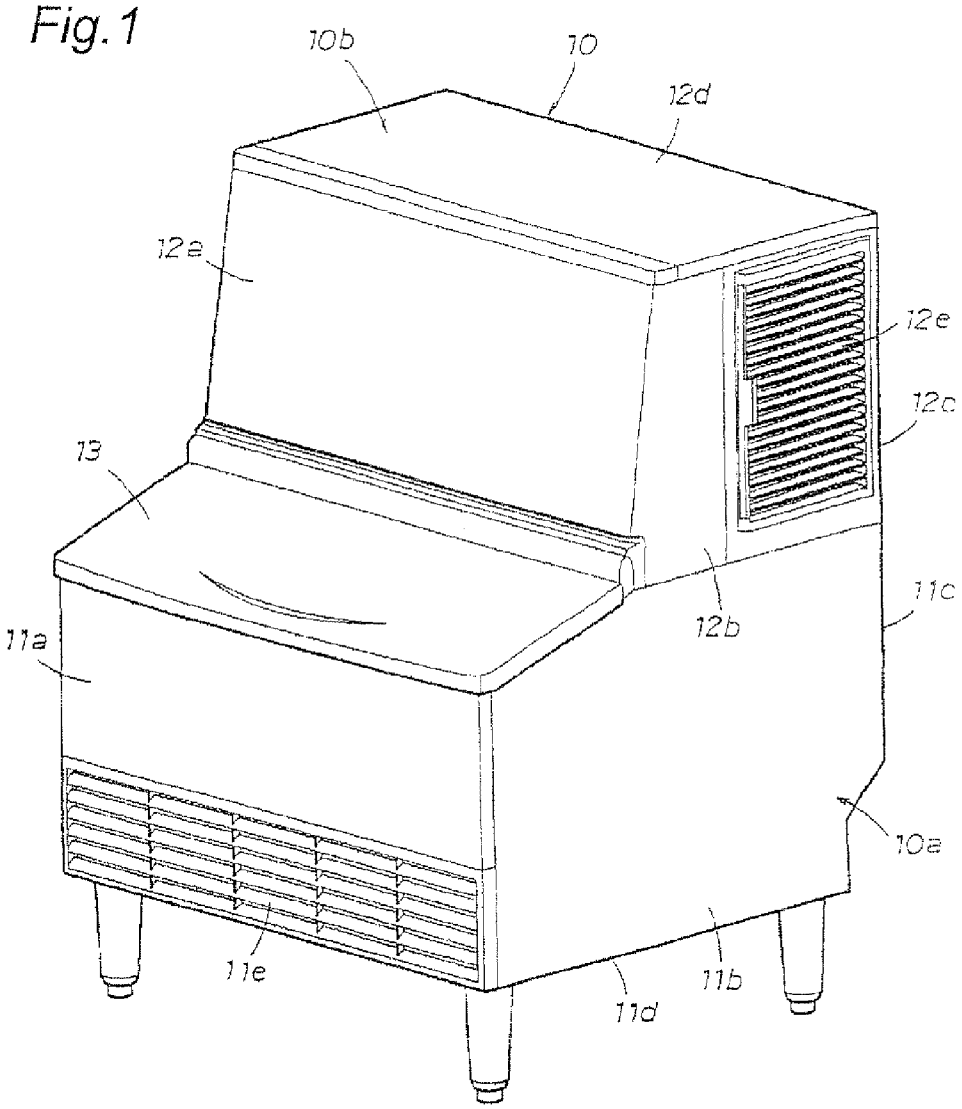
FIG. 1 is a perspective view of an ice-making machine looking from the right-hand front in an exemplary embodiment of the present invention.
Figure 3:
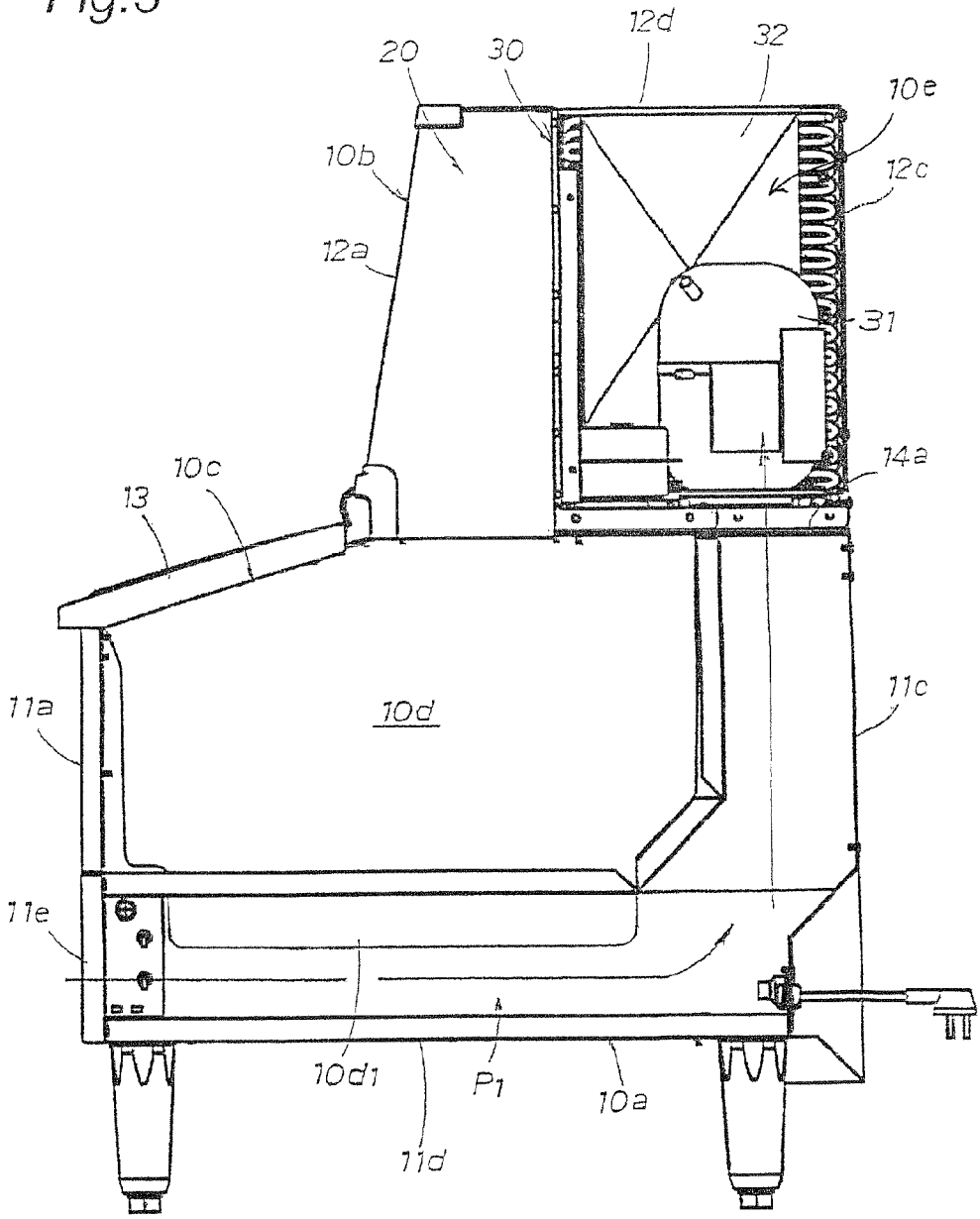
FIG. 3 is a right-hand view of the ice-making machine in a condition where a right-hand panel was removed.

Hereinafter, a preferred embodiment of an ice-making machine according to the present invention will be described with the drawings. As shown in FIG. 1, a housing body 10 of the ice-making machine is composed of a lower housing 10*a* in the form of a square box opened upward and an upper housing 10*b* in the form of a box mounted on an upper periphery of the lower housing and opened downward. As shown in FIG. 3, an ice storage bin 10*d* is provided within the interior of lower housing 10*a*, and a machine compartment 10*e* is formed in the interior of upper housing 10*b*. The front panel 12*a* of upper housing 10*b* is spaced backward from the front panel 11*a* of lower housing 10*a*. A rectangular opening 10*c* of the ice storage bin is laterally formed between the lower end of front panel 12*a* and the upper end of front panel 11*a*.

The rectangular opening 10*c* is located above the front portion of ice storage bin 10*d* for takeout of ice cubes stored in the storage bin, and a rectangular lid 13 is pivoted at its rear end to the lower end of front panel 12*a* of upper housing 10*b* to be moved up and down for opening and closing the ice storage bin.

In the housing body 10 shown in FIG. 1, left-hand and right-hand panels 11*b* of lower housing 10*a* are assembled with left-hand and right-hand panels 12*b* of upper housing 10*b* in a common surface. Similarly, the back panel 11*c* of lower housing 10*a* is assembled with the back panel 12*c* of upper housing 10*b* in a common surface. A first louver 11*e* is detachably fitted to a lateral opening between the front panel 11*a* of lower housing 10*a* and the front end of a bottom plate 11*d*. A second louver 12*e* is detachably fitted to an opening between the right-hand panel 12*b* of upper housing 10*b* and a top plate 12*d*, and a third louver 11*f* is detachably fitted to the back panel 11*c* of lower housing 10*a*. (see FIG. 5)

The ice storage bin 10*d* provided within the lower housing 10*a* is in the form of a square box opened upward and formed at its bottom with a recessed portion 10*d*1 in a front-to-rear direction. As shown in FIG. 3, an air intake passage P1 is formed at the right-hand of ice storage bin 10*d* by means of a space between the right-hand wall of ice storage bin and an inner surface of the right-hand panel 11*b* of lower housing 10*a* and a space between the rear wall of ice storage bin 10*d* and an inner surface of the back panel 11*c* of lower housing 10*a*. The air intake passage P1 opens toward the right-hand of first louver 11*e* at its front end and opens toward the right-hand bottom 14*a* of the machine compartment 10*e* at its upper end. The air intake passage P1 may be opened toward the second louver 12*e* at its intermediate portion.

Figure 4:
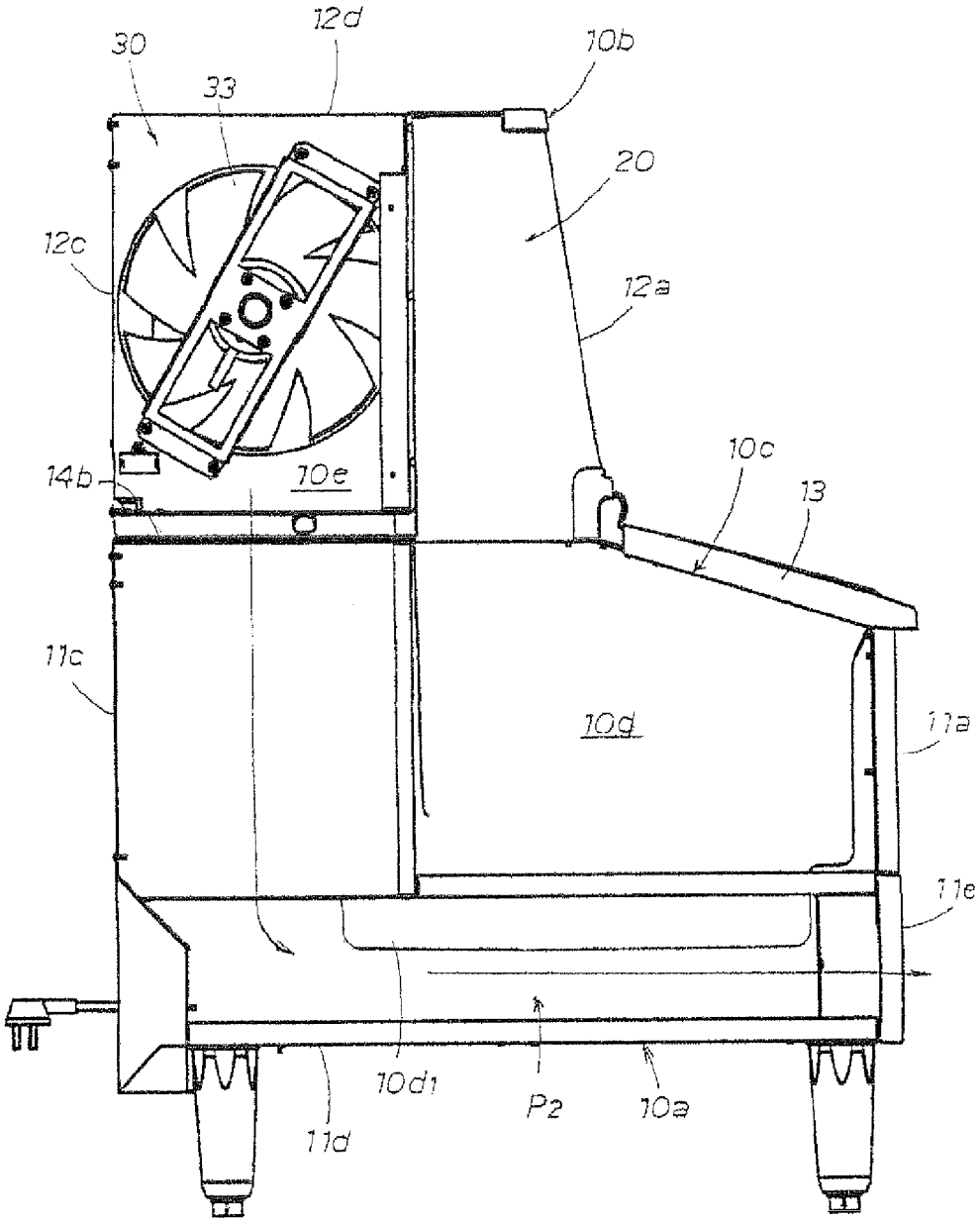
FIG. 4 is a left-hand view of the ice-making machine in a condition where a left-hand panel was removed.

As shown in FIG. 4, an air discharge passage P2 is formed at the left-hand of ice storage bin 10*d* by means of a space between the left-hand wall of ice storage bin 10*d* and an inner surface of the left-hand panel 11*b* of lower housing 10*a* and a space between the back wall of ice storage bin 10*d* and an inner surface of the back panel 11*c* of lower housing 10*a*. The air discharge passage P2 opens toward the left-hand of first louver 11*e* at its front end and opens toward the left-hand bottom 14*b* of the machine compartment 10*e* at its upper end. The air discharge passage P2 may be opened toward the third louver 11*f* at its intermediate portion.

Figure 2:
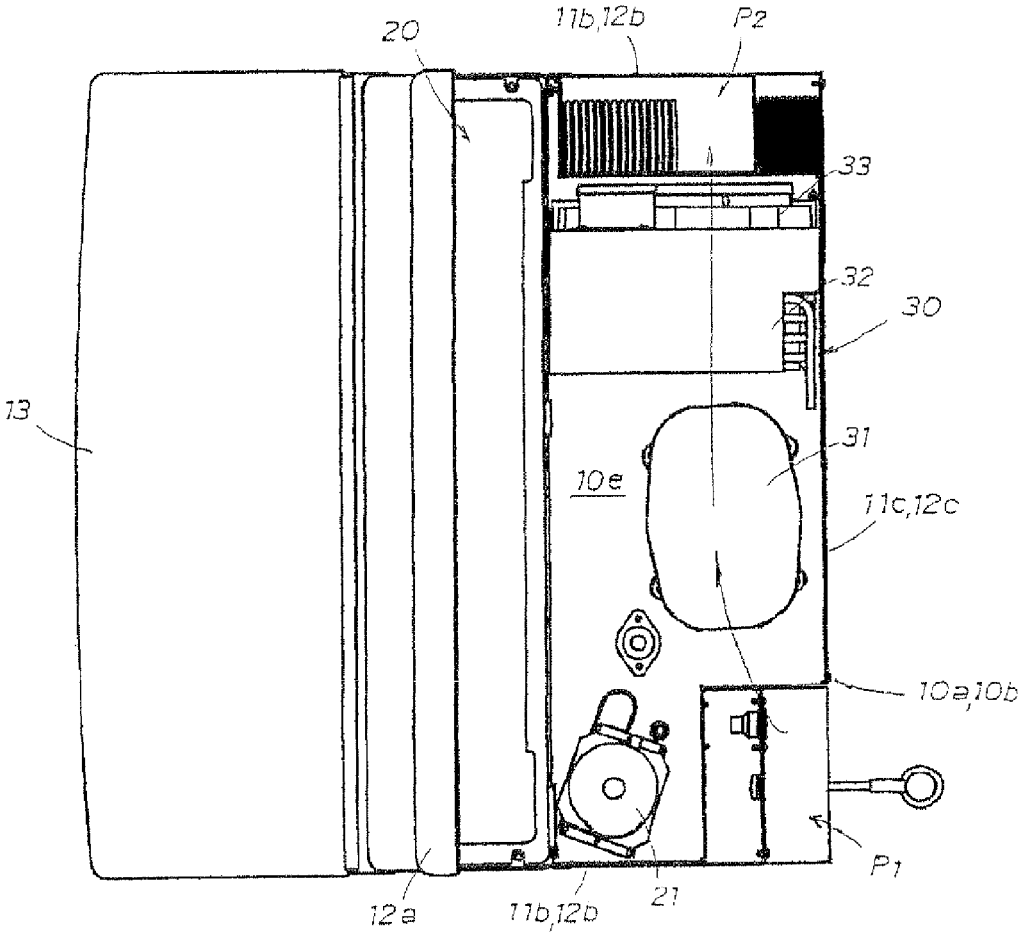
FIG. 2 is a plan view of the ice-making machine in a condition where a top plate was removed.
Figure 5:
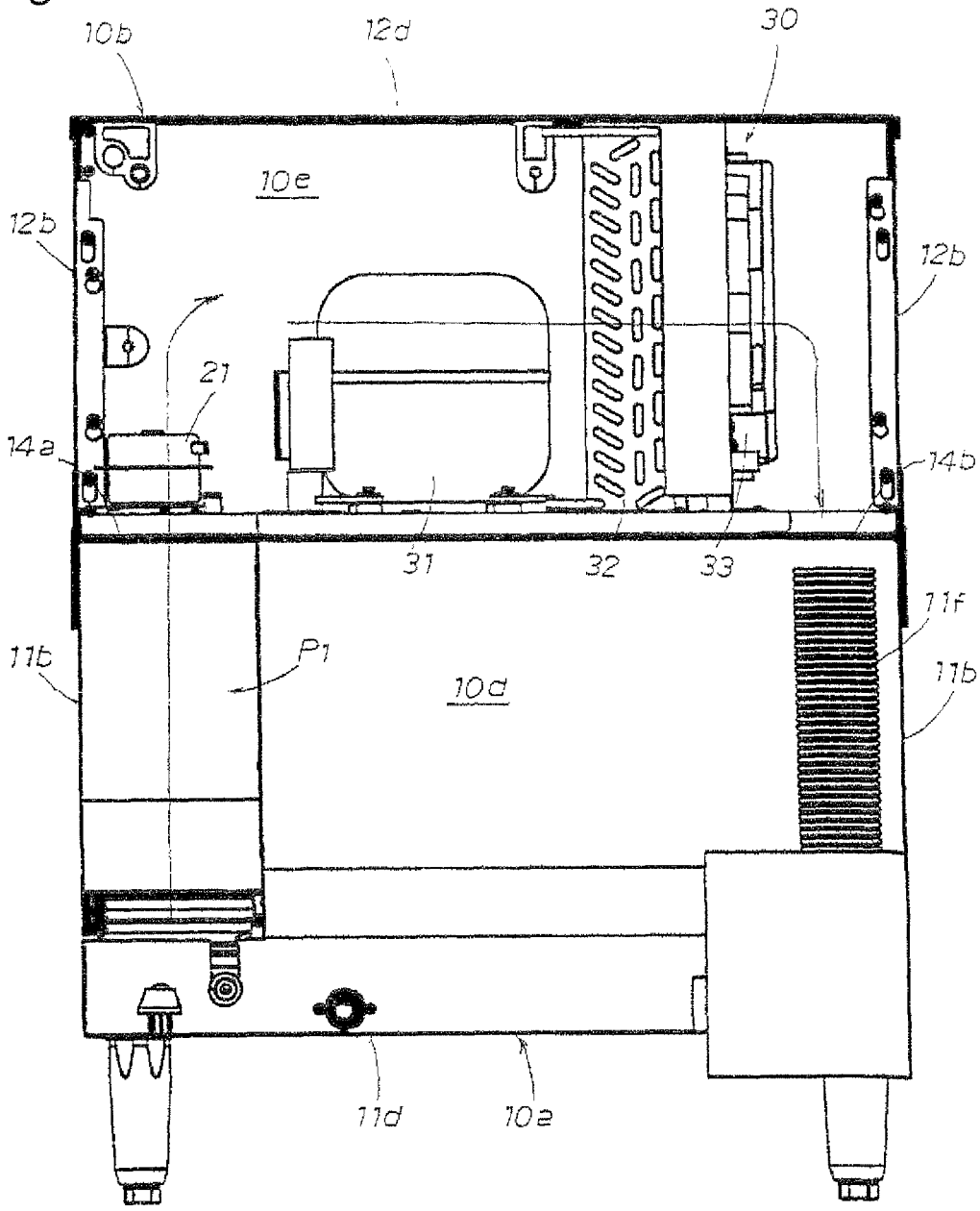
FIG. 5 is a rear view of the ice-making machine in a condition where a back panel was removed.

In the machine compartment 10*e* formed in the upper housing 10*b*, an ice-making mechanism 20 is installed at the front of machine compartment 10*e* in a condition housed in a casing, and a freezing unit 30 is installed behind the ice-making mechanism 20. As shown in FIGS. 2 and 5, the freezing unit 30 includes a compressor 31, a condenser 32 and a cooling fan 33 as main component parts thereof. The compressor 31, condenser 32 and cooling fan 33 are arranged in sequence from the right-hand between the opening 14*a* of air intake passage P1 and the opening 14*b* of air discharge passage P2 located at the bottom of machine compartment 10*e*. In such arrangement of the component parts of freezing unit 30, the compressor 31 is positioned at one side of the opening 14*a* of air intake passage P1, and the cooling fan 33 is positioned at one side of the opening 14*b* of air discharge passage P2. In FIGS. 2 and 5, the reference numeral 21 designates a water pump for supplying water to an ice-making plate of ice-making mechanism 20.

When the ice-making machine is started by activation of the ice-making mechanism 20 and freezing unit 30, ice cubes produced at the ice-making mechanism 20 are stored in the ice storage bin 10*d*, while the cooling fan 33 is operated to introduce the outside air into the air intake passage P1. The outside air is supplied as cooling air into the interior of machine compartment 10*e* and exhausted to the exterior through the air discharge passage P2. In such an instance, the outside air is also introduced into the intermediate portion of air intake passage P1 through the second louver 12*e* fitted to the right-hand panel 12*b* of upper housing 10*b*, and the air flowing through the discharge passage P2 after cooled the machine compartment 10*e* is exhausted through the third louver 11*f* fitted to the back panel 11*c* of lower housing 10*a*. Thus, the freezing unit 30 is efficiently cooled by the air flowing around the ice storage bin 10*d*, and ice cubes stored in the ice storage bin 10*d* can be scooped out when the lid is opened by a user.

As the freezing unit 30 in the ice-making machine is installed behind the ice-making mechanism 20 and apart from the front of the housing body 10, its use will not cause suffering from unpleasant noises caused by operation of the freezing unit when the lid is opened to scoop ice cubes out of the ice storage bin. The ice-making mechanism 20 and freezing unit 30 installed in the machine compartment 10*e* can be easily inspected for maintenance. As the ice storage bin 10*d* can be enlarged in a flat condition without being formed downwardly deep at its bottom, a small amount of ice cubes remaining in the bottom of storage bin 10*d* can be easily scooped out. In the ice-making machine, it is also advantageous that the recessed portion 10*d*1 formed at the center of the flat bottom of ice storage bin 10*d* is useful to facilitate takeout of a small amount of remaining ice cubes. As the upper housing 10*b* is mounted on the rear portion of lower housing 10*a* for installation of the ice-making mechanism 20 and freezing unit 30 therein, the opening 10*c* of ice storage bin 10*d* can be enlarged to facilitate takeout of ice cubes.

As the air intake passage P1 and air discharge passage P2 are opened at the front of lower housing 10*a*, the ice-making machine can be positioned closely along a side wall behind a desired installation place or installed in a deep space under an appropriate service counter.

REFERENCE NUMERALS

10 . . . Housing body, 10*a* . . . Lower housing, 10*b* . . . Upper housing, 10*c* . . . Ice takeout opening, 10*d* . . . Ice storage bin, 10*d*1 . . . Recessed portion, 10*e* . . . Machine compartment, 11*a* . . . Front panel of lower housing, 11*b* . . . Left-hand and right-hand panels of lower housing, 11*c* . . . Back panel of lower housing, 11*d* . . . Bottom plate of lower housing, 11*e* . . . Front louver of lower housing, 11*f* . . . Back louver of lower housing, 12*a* . . . Front panel of upper housing, 12*b* . . . Left-hand and right-hand panels of upper housing, 12*c* . . . Back panel of upper housing, 12*d* . . . Top plate of upper housing, 12*e* . . . Side louver of top housing, 13 . . . Open-and-close lid, 20 . . . Ice-making mechanism, 21 . . . Water pump, 30 . . . Freezing unit, 31 . . . Compressor, 32 . . . Condenser, 33 . . . Cooling fan, P1 . . . Air intake passage, P2 . . . Air discharge passage.

The invention claimed is:

1. An ice-making machine comprising:

a box-shaped lower housing having an ice storage bin, a box-shaped upper housing mounted on a rear portion of the lower housing, an ice-making mechanism disposed within a front portion of a machine compartment in the upper housing, and a freezing unit disposed behind the ice-making mechanism and configured to supply liquid refrigerant to the ice-making mechanism, wherein an open-and-close lid is mounted on an opening formed between a lower end of a front face of the upper housing and an upper end of a front face of the lower housing, wherein an air intake passage is open at the front face of the lower housing and is configured to allow outside air introduced from the front face of the lower housing to flow as cooling air into the machine compartment through (a) a space between the ice storage bin and a first side wall of the lower housing and (b) a space between the ice storage bin and a rear wall of the lower housing, and wherein an air discharge passage is configured to allow air exhausted from the machine compartment after cooling the freezing unit through (c) a space between the ice storage bin and the rear wall of the lower housing, and (d) a space between a second side wall of the lower housing and the ice storage bin.

2. An ice-making machine as claimed in claim 1, wherein:

the open-and-close lid is pivoted at a rear end to a front lower end of the upper housing so as to be movable upward for opening the ice storage bin and movable downward for closing the ice storage bin.

3. An ice-making machine as claimed in claim 1, wherein:

the upper housing is provided at a side wall with an auxiliary air intake opening in communication with the air intake passage.

4. An ice-making machine as claimed in claim 1, wherein:

the lower housing is provided at the rear wall thereof with an auxiliary air discharge opening in communication with the air discharge passage.

5. A self-contained ice-making machine, comprising:

an ice storage bin disposed below an ice-making mechanism, both said storage bin and said ice-making mechanism being disposed within exterior housing walls to define a self-contained ice-making machine;

an inlet air cooling passage configured to allow cooling air to flow (a) inwardly through a first side front face of said exterior housing walls, (b) rearwardly between a first side of said exterior housing walls and said ice storage bin, and (d) upwardly inside said first side exterior housing walls onward to said ice-making mechanism; and an exhaust air cooling passage configured to allow used cooling air to flow (e) from said ice-making mechanism downwardly inside a second opposite side of said exterior housing walls, (f) forwardly between the second side of said exterior housing walls and said ice storage bin, and (g) outwardly through a second opposite side of the front face of said exterior housing walls.

6. The self-contained ice-making machine of claim 5, further comprising:

an open-and-close lid extending rearwardly over a front top portion of said ice storage bin, said lid being pivoted at a rear edge thereof so as to be pivotable upwardly to open the ice storage bin for access to ice stored therein and pivotable downwardly to close the ice storage bin.

7. The self-contained ice-making machine of claim 5, further comprising:

an auxiliary air intake opening through the first side of said exterior housing walls and in air-flow communication with said inlet air cooling passage at a location opposite said ice-making mechanism.

8. The self-contained ice-making machine of claim 5, further comprising:

an auxiliary exhaust air opening through a lower rear side of said exterior housing walls and in air-flow communication with said exhaust air cooling passage.

* * * * *